US007686100B2

(12) United States Patent
Codazzi et al.

(10) Patent No.: US 7,686,100 B2
(45) Date of Patent: Mar. 30, 2010

(54) TECHNIQUE AND APPARATUS FOR DRILLING AND COMPLETING A WELL IN ONE HALF TRIP

(75) Inventors: Daniel Codazzi, Gif sur Yvette (FR); Iain Cooper, Sugar Land, TX (US); Jeremy Hughes, Calgary (CA); Spyro Kotsonis, Le Plessis Robinson (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 696 days.

(21) Appl. No.: 11/461,887

(22) Filed: Aug. 2, 2006

(65) Prior Publication Data

US 2008/0029303 A1 Feb. 7, 2008

(51) Int. Cl.
*E21B 4/02* (2006.01)
*E21B 43/00* (2006.01)

(52) U.S. Cl. ..... 175/57; 175/107; 175/230; 166/369; 166/106

(58) Field of Classification Search ..... 166/369, 166/105, 685, 106; 175/107, 87, 230
See application file for complete search history.

(56) References Cited

U.S. PATENT DOCUMENTS

| | | | | |
|---|---|---|---|---|
| 2,898,087 | A * | 8/1959 | Clark | 175/99 |
| 5,139,400 | A | 8/1992 | Ide | |
| 5,551,521 | A | 9/1996 | Vail, III | |
| 5,894,897 | A | 4/1999 | Vail, III | |
| 6,026,904 | A * | 2/2000 | Burd et al. | 166/313 |
| 6,263,987 | B1 | 7/2001 | Vail, III | |
| 6,397,946 | B1 | 6/2002 | Vail, III | |
| 6,837,313 | B2 * | 1/2005 | Hosie et al. | 175/25 |
| 2002/0189570 | A1 | 12/2002 | Kaesgen | |
| 2004/0129456 | A1 | 7/2004 | Vail, III | |
| 2004/0256161 | A1 | 12/2004 | Aronstam et al. | |

FOREIGN PATENT DOCUMENTS

| | | |
|---|---|---|
| EP | 1096104 B1 | 5/2001 |
| GB | 2339598 A | 2/2002 |
| WO | 9416198 A1 | 7/1994 |

* cited by examiner

*Primary Examiner*—David J Bagnell
*Assistant Examiner*—Robert E Fuller
(74) *Attorney, Agent, or Firm*—David Cate; Robin Nava; Jeff Griffin

(57) ABSTRACT

A technique that is usable with a well includes running a motor into the well and actuating the motor to turn a drill bit. The motor is used to pump well fluid from the well.

24 Claims, 7 Drawing Sheets

TECHNIQUE AND APPARATUS FOR DRILLING AND COMPLETING A WELL IN ONE HALF TRIP

BACKGROUND

The invention generally relates to a technique and apparatus for drilling and completing a well in one half trip.

One way to drill a hydrocarbon well is to use the hydraulic power of drilling fluid (mud or water, as a few examples) to turn a drill bit. More specifically, a conventional drill string may include, among other components, a drill bit and a motor (called a "mud motor") that is located near the bottom of the string above the drill bit. The drilling fluid typically flows from a mud pump at the surface of the well, through the central passageway of the drill string and returns to the mud pump via the annulus of the well. During drilling, the drill string remains stationary (as an example), and the drilling fluid exerts a rotational force on a rotor of the mud motor, which causes the drill bit (which is connected to the rotor) to turn. Besides driving the rotation of the drill bit, the drilling fluid may serve other functions, such as cooling off the drill bit, returning removed earth to the surface of the well and suppressing production.

A casing string may be installed as the well is being drilled. The installation of the casing string may be the first of many steps to complete the well, as typically, several downhole trips directed to well completion are made after the drilling operation. The downhole trips (defined as a round trip into and out of the wellbore) may include, for example, a trip to perforate the well and one or more trips to install production tubing, pumps, packers, liners, sand screens, etc. Each trip into the well typically increases the cost of completing the well.

Thus, there is a continuing need for better ways to reduce the number of downhole trips used to complete a well.

SUMMARY

In an embodiment of the invention, a technique that is usable with a well includes running a motor into the well and actuating the motor to turn a drill bit. The motor is also used to pump well fluid from the well.

In another embodiment of the invention, an assembly that is usable with a well includes a tubular member, a shaft, a first actuator and a second actuator. The shaft is disposed in the tubular member. The first actuator is adapted to, in a motor mode of the assembly, turn the shaft in response to fluid that is communicated through the tubular member from the surface of the well. The second actuator is adapted to, in a pump mode of the assembly, turn the shaft to pump well fluid from downhole to the surface of the well.

In another embodiment of the invention, a system that is usable with a well includes a string, an isolation device, a drill bit and an assembly. The isolation device is adapted to be selectively activated to isolate an annular region outside of the string. The assembly is adapted to, in a first mode, turn the drill bit and, in a second mode, pump well fluid from downhole to the surface of the well.

Advantages and other features of the invention will become apparent from the following drawing, description and claims.

DETAILED DESCRIPTION

Figure 1:
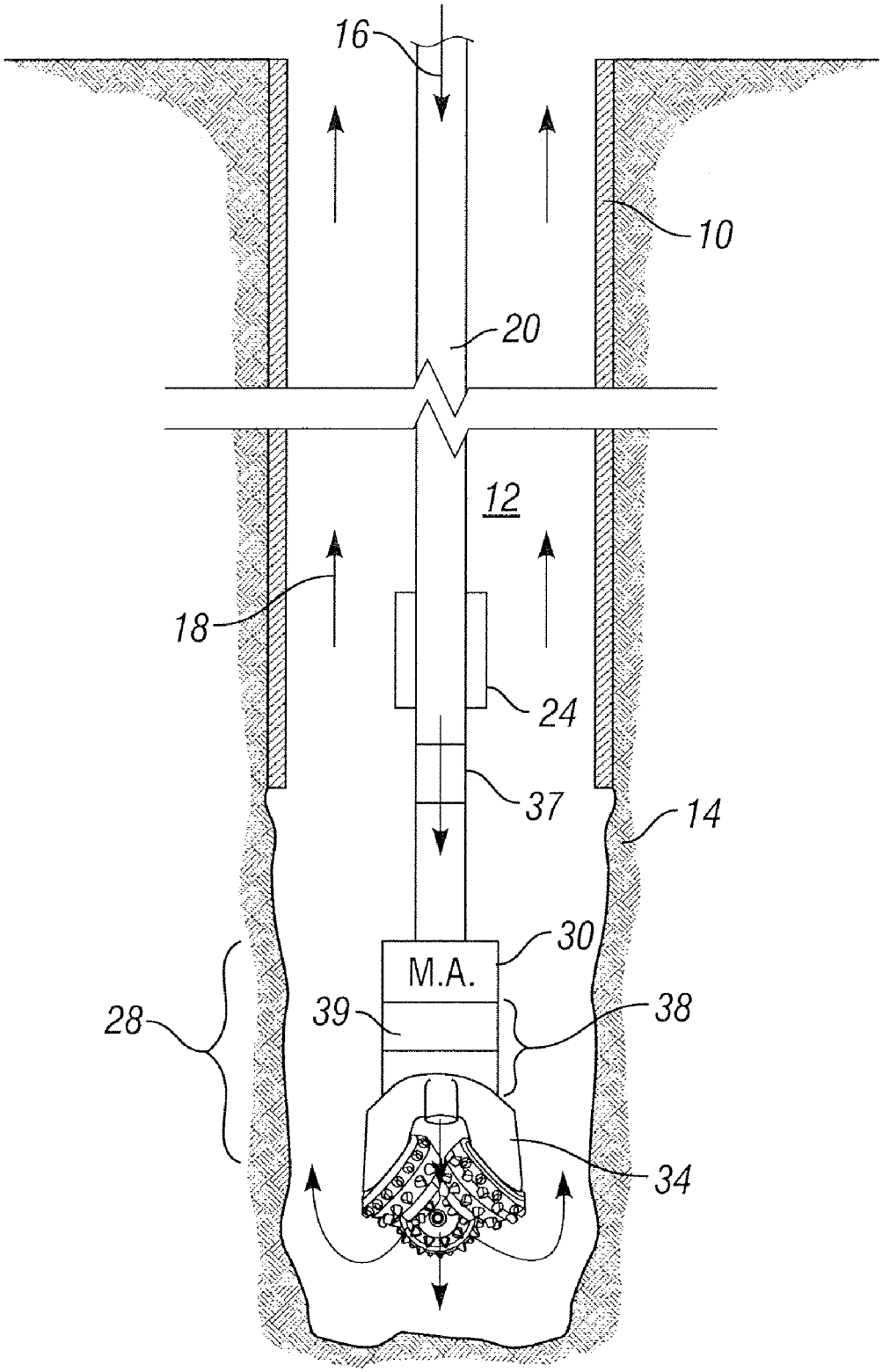
FIG. 1 is a schematic diagram of a string being used in a drilling operation in accordance with an embodiment of the invention.

Referring to FIG. 1, in accordance with some embodiments of the invention, a downhole motor assembly 30 is constructed to function both as a drilling motor and a well fluid pump. More specifically, in accordance with some embodiments of the invention, the motor assembly 30 is part of a bottom hole assembly 28 of a tubular string 20. Above the bottom hole assembly 28, the string 20 may, as examples, be coiled tubing or may be a tubular structure formed from jointed tubing sections, depending on the particular embodiment of the invention. Additionally, the well in which the string 20 is deployed may be a subterranean well or a subsea well, depending on the particular embodiment of the invention. Furthermore, the well may or may not be lined by a casing string 10, depending on the particular embodiment of the invention. Thus, these and many other variations are possible and are within the scope of the appended claims.

The motor assembly 30 is constructed to operate in one of two different modes of operation. In a first mode of operation, the motor assembly 30 functions as a drilling fluid motor, or "mud motor," for purposes of rotating a drill bit 34 of the bottom hole assembly 28. In a second mode of operation, the motor assembly 30 functions as a well fluid pump to pump well fluid through the string 20 to the surface of the well. Thus, in use, the motor assembly 30 is first operated in the first mode of operation for purposes of drilling a well and is then operated in the second mode of operation to pump well fluid from the well.

Therefore, the string 20 initially functions as a drill string, and as part of the drill string, the motor assembly 30 operates in its first mode of operation to rotate the drill bit 34 to extend the borehole, as depicted at reference numeral 14. The motor assembly's rotation of the drill bit 34 occurs in response to drilling fluid that circulates in a path, which includes the string's central passageway and an annulus 12 of the well. More specifically, the drilling fluid exits a mud pump (not shown) at the surface of the well to form a flow 16 through the central passageway of the string 20, and the flow 16 actuates the motor assembly 30 to cause the assembly 30 to rotate the drill bit 34. Upon exiting nozzles (not shown) near the drill bit 34, the drilling fluid forms a flow 18 (in the annulus 12) back to the surface of the well.

In addition to the bottom hole assembly 28, the string 20 may include various other components or tools, depending on the particular embodiment of the invention. For example, in accordance with some embodiments of the invention, the string 20 includes an isolation device 24 that may be activated, or "set," to form an annular seal between the exterior of the string 20 and the surrounding wellbore or casing string 10, depending on whether the well is cased. More particularly, when the motor assembly 30 is in its first mode of operation (and therefore, used as a mud motor), the isolation device 24 remains de-activated, or unset, to leave the annulus 12 unrestricted and permit the return flow 18 of the drilling fluid to the surface of the well. However, as further described below, in its second mode of operation, the motor assembly 30 serves as a production fluid pump; and for this mode of operation, the isolation device 24 is activated to create a seal inside the annulus 12. More specifically, the activation of the isolation device 24 forms an annular seal to isolate the annular region below the isolation device 24 from the annular region above the isolation device 24.

Among its other features, in accordance with some embodiments of the invention, the bottom hole assembly 28 includes a circulation valve 38 that is closed in the first mode of operation of the motor assembly 30. However, for the second mode of operation of the motor assembly 30, the valve 38 is opened for purposes of facilitating well fluid flow into the central passageway of the string 20.

Figure 2:
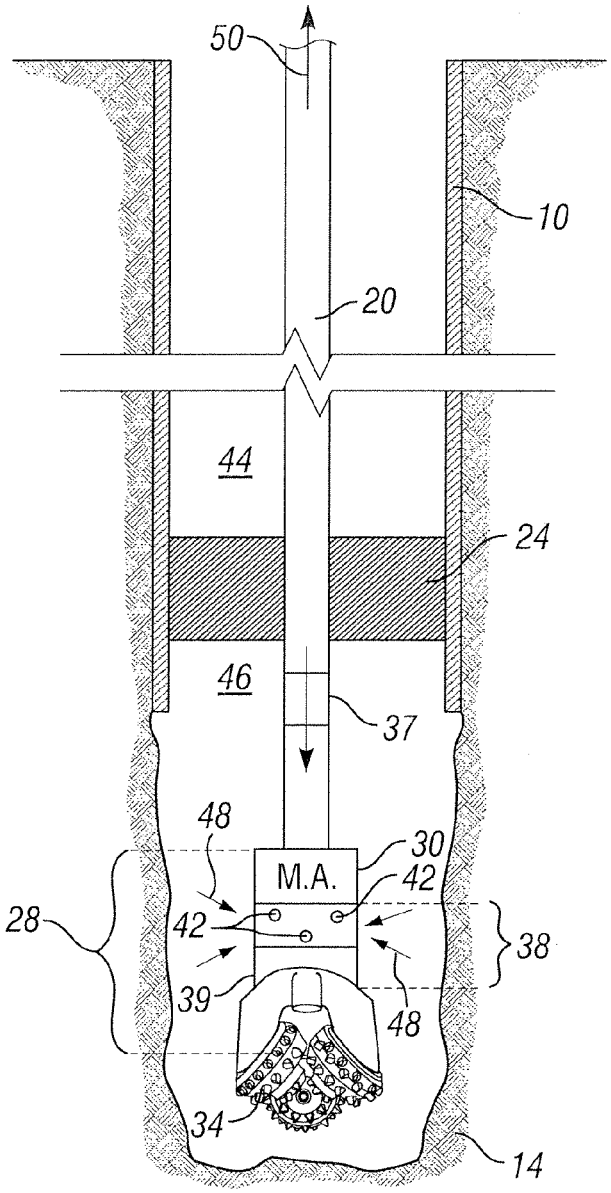
FIG. 2 is a schematic diagram illustrating the string being used in a production operation in accordance with an embodiment of the invention.

FIG. 2 depicts the string 20 for the second mode of operation of the motor assembly 30, a mode in which the string 20 serves as a production string to communicate a flow 50 of well fluid through the central passageway of the string 20 to the surface of the well. Additionally, for the second mode of operation, the valve 38 opens to expose various radial well fluid communication ports 42 for purposes of facilitating entry of well fluid (as depicted by a flow 48 in FIG. 2) into the central passageway of the string 20. It is noted that well fluid may also flow into the string 20 via the drilling nozzles (not shown) that are located near the drill bit 34. However, the opening of the valve 38 provides an increased flow area into the string 20 for the second mode of operation.

As depicted in FIG. 2, in accordance with some embodiments of the invention, the valve 38 may be a sleeve valve, which includes a sleeve 39 that slides between an open position (depicted in FIG. 2) and its initial closed position (depicted in FIG. 1). As also depicted in FIG. 2, when the motor assembly 30 is in the second mode of operation, the isolation device 24 is activated, or set. More specifically, when set, the isolation device 24 radially expands to isolate the annulus of the well to create a lower region 46 below the isolation device 24 and an upper region 44 above the isolation device 24.

Thus, when operating in its second mode of operation, the motor assembly 30 functions to pump well fluid from the lower region 46 into the central passageway of the string 20, where the corresponding flow 50 is formed (due to the pumping by the motor assembly 30) to the surface of the well.

Due to the above-described two operational modes of the motor assembly 30, the well may be drilled and completed in only a half trip (i.e., the equipment is run into the well without being pulled out of hole), thereby potentially resulting in a substantial reduction in the cost of completing the well.

In accordance with other embodiments of the invention, a valve that is controlled by the pressure differential that is established by the motor assembly 30 may be substituted for the valve 38. This other valve may include radial ports that are designed (when the valve is open) to communicate fluid between the annulus and the central passageway of the string 20. Communication through the ports may be controlled by a rupture disk. During the drilling of the well, the pressure differential between the inside and the outside of the string 20 is not sufficient to rupture the disk. However, upon conversion of the motor assembly 30 into a production fluid pump, operation of the assembly 30 creates a local pressure depression (created by trying to pump the well fluid through nozzles of the bottom hole assembly 28, for example), which ruptures the disk and opens flow through the radial ports. Alternatively, the above-described pressure differential may be used in a valve (substituted for the valve) to shear a shear pin of the valve for purposes of freeing a mechanical sleeve (which is driven by the pressure differential) to open and allow communication through radial flow ports. Thus, many variations are possible and are within the scope of the appended claims.

Figure 3:
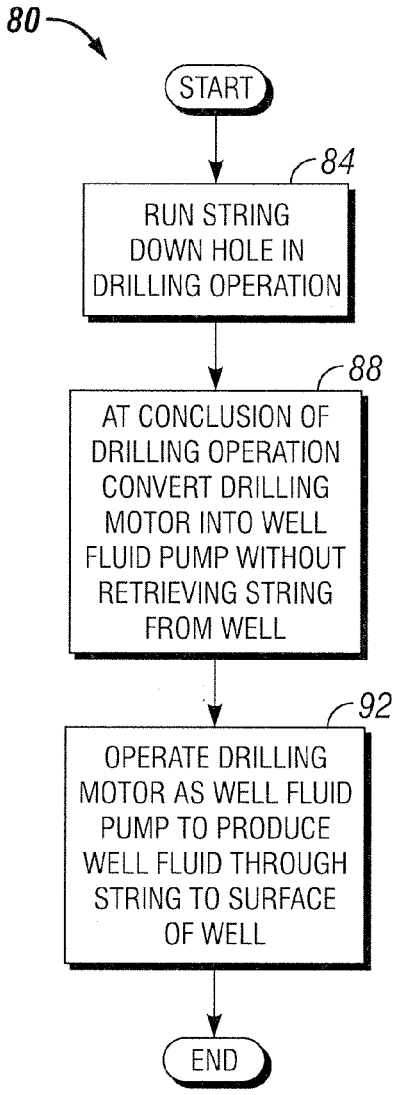
FIG. 3 is a flow diagram depicting a technique to drill and complete a well according to embodiments of the invention.

Referring to FIG. 3, to summarize, in accordance with some embodiments of the invention, a technique 80 to drill and complete a well includes running (block 84) a string (such as the string 20) downhole in a drilling operation and at the conclusion of the drilling operation, converting (block 88) a drilling motor (such as the motor assembly 30) of the string into a well fluid pump, without retrieving the string from the well. The drilling motor is then operated as a well fluid pump to produce well fluid through the string to the surface of the well, pursuant to block 92.

For purposes of simplifying the description of the dual modes of operation of the motor assembly 30, a simplified version of the bottom hole assembly 28 is depicted in FIGS. 1 and 2. However, the bottom hole assembly 28 may include various other components, depending on the particular embodiment of the invention. For example, in accordance with some embodiments of the invention, the bottom hole assembly 28 may include a bent sub and/or stabilizers, which may be useful for purposes of directional drilling. Furthermore, in accordance with embodiments of the invention, the bottom hole assembly 28 may include a sand control mechanism, such as a sand screen, an expandable sand screen or an inflatable screen or slotted liner. In accordance with some embodiments of the invention, the bottom hole assembly 28 may include a sand screen with soluble slots that are configured to open when the drilling motor is operated as a well fluid pump. The bottom hole assembly 28 may also include, as additional examples, an electric or hydraulic orienter and possibly rotary tools.

Figure 4:
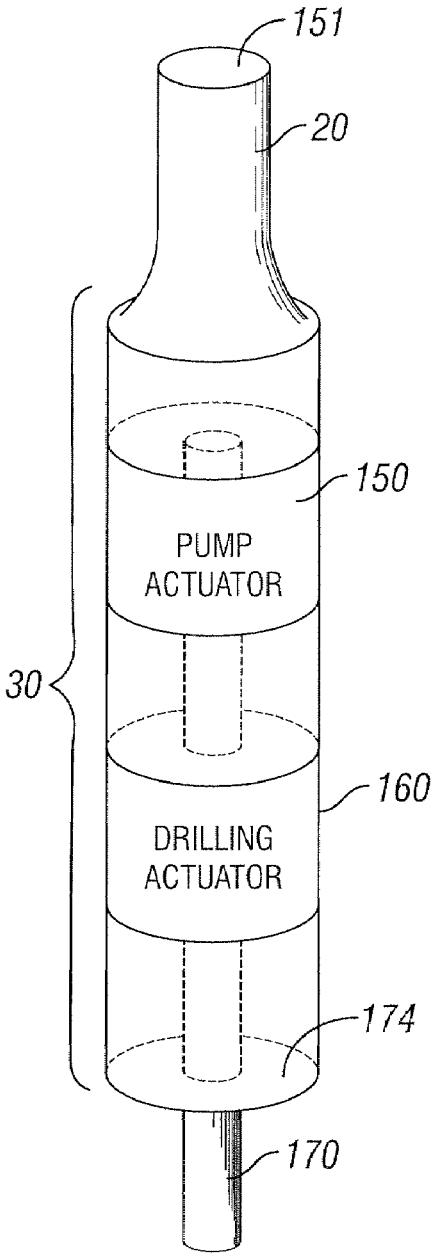
FIG. 4 is a schematic diagram of a motor assembly according to an embodiment of the invention.

Referring to FIG. 4, in accordance with some embodiments of the invention, the motor assembly 30 includes a drilling actuator 160 that, in the first mode of operation, responds to drilling fluid that flows between upper 151 and lower 174 ports of the motor assembly 30 to rotate a shaft 170, which is connected to the drill bit 34 (see FIG. 1). The string 20 remains stationary, in accordance with some embodiments of the invention. However, the drilling fluid provides hydraulic power to exert a rotational force on the shaft 170 to cause the shaft 170 (and drill bit 34) to rotate relative to the string 20. As examples, the drilling actuator 160 may be a positive displacement motor (PDM) or a turbine-based motor, depending on the particular embodiment of the invention. Regardless of the particular form of the drilling actuator 160, the drilling actuator 160 converts the drilling fluid flow into rotation of the drill bit 34.

In accordance with other embodiments of the invention, the string 20 may rotate during drilling. For example, in accordance with some embodiments of the invention, the string 20 may be formed from jointed tubing sections and may be rotated during drilling to increase the rate of penetration (ROP) and drilling operation's hole cleaning ability. Furthermore, in accordance with some embodiments of the invention, the bottom hole assembly 28 may include a bent sub for purposes of directional drilling, and as such, the string 20 may need to slide and rotate. Thus, many variations are possible and are within the scope of the appended claims.

In accordance with some embodiments of the invention, the motor assembly 30 also includes a pump actuator 150. The pump actuator 150 is connected to the shaft 170 for purposes of rotating the shaft 170 during the second mode of operation in which the motor assembly 30 functions as a well fluid pump. More specifically, the pump actuator 150 remains inactive during the first mode of operation, in which the assembly 30 functions as a drilling motor. At the conclusion of the first mode of operation, the flow of drilling fluid through the motor assembly 30 ceases, and the shaft 170 stops rotating. At this point, energy (hydraulic, mechanical or electrical, as examples) is supplied from the surface of the well to activate the pump actuator 150, an activation that causes the pump actuator 150 to turn the shaft 170.

More specifically, in accordance with some embodiments of the invention, when activated, the pump actuator 150 rotates the shaft 170 in an opposite direction from the rotation of the shaft 170 during the first mode. It is noted that the drill bit may or may not turn during the second mode of operation, depending on the particular embodiment of the invention.

The rotation of the shaft 170 by the pump actuator 150 causes the drilling actuator 160 to become a pump. In other words, due to the rotation of the shaft 170, the drilling actuator 160 creates a pressure drop that causes the motor assembly 30 to receive well fluid through the lower port 174 and communicate this well fluid through the upper port 151 into the central passageway of the string 20 to form the flow 50 (see FIG. 2) to the surface. In accordance with some embodiments of the invention, the drilling actuator 160, pump actuator 150 and shaft 170 form a centrifugal pump.

Although FIG. 4 depicts the pump actuator 150 as being above the drilling actuator 160, these positions may be switched in accordance with other embodiments of the invention. The arrangement of the pump actuator 150 below the drilling actuator 160 may be advantageous for cooling purposes.

Figure 5:
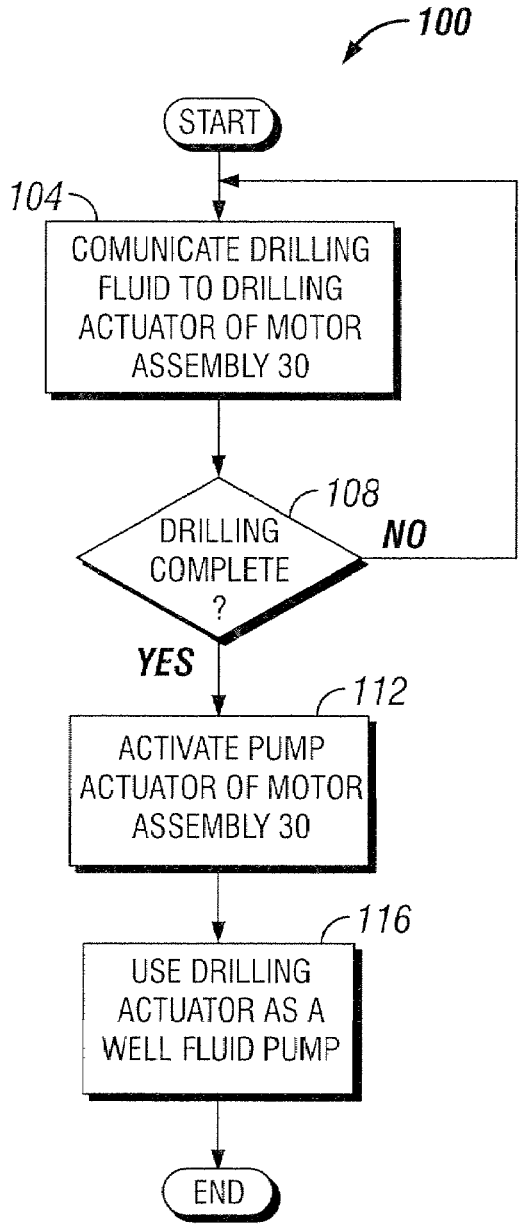
FIG. 5 is a flow diagram depicting a technique to drill and complete a well according to embodiments of the invention.

Referring to FIG. 5, to summarize, a technique 100 may be used for purposes of operating the motor assembly 30 in accordance with some embodiments of the invention. Pursuant to the technique 100 in the first mode of operation, drilling fluid is communicated to the drilling actuator 160 of the motor assembly 30, pursuant to block 104. After completion of the drilling operation (diamond 108) the pump actuator 150 of the motor assembly 30 is activated (block 112). The activation of the pump actuator 150, in turn, converts the drilling actuator 160 into a well fluid pump, pursuant to block 116.

Figure 6:
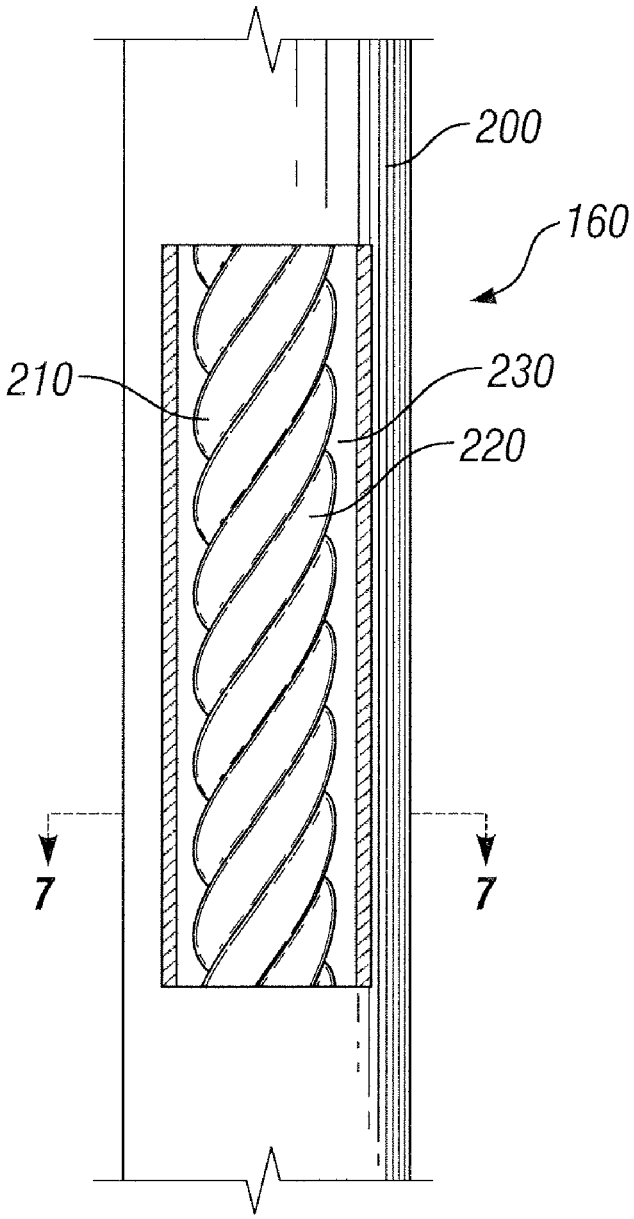
FIG. 6 is a schematic diagram of a drilling actuator according to an embodiment of the invention.
Figure 7:
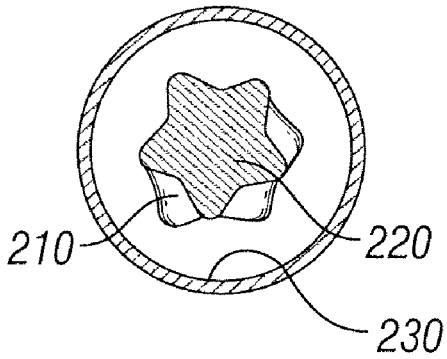
FIG. 7 is a cross-sectional view taken along line 7-7 of FIG. 6 according to an embodiment of the invention.

Referring to FIG. 6, in accordance with some embodiments of the invention, the drilling actuator 160 includes a rotor 220 that is connected to the shaft 170 (see FIG. 3). The rotor 220 includes helically-disposed ribs that convert the force that is exerted by the mud flow into rotation of the shaft 170 and rotor 220. More specifically, referring also to the cross-section that is depicted in FIG. 7, the drilling actuator 160 includes a housing 230, which, in turn, encases a stator 230. The stator 230 forms a chamber 210 in which the rotor 220 turns. The profile of the chamber 210 produces variably-sized and continually changing pockets between the rotor 220 and the housing 230 as the rotor 220 turns. Movement of the drilling fluid through the chamber 210 produces corresponding rotation of the rotor 220. Conversely, during the second mode of operation of the motor assembly 30, the driven rotation of the rotor 220 by the pump actuator 150 causes corresponding fluid movement through the chamber 210, as the drilling actuator 160 functions as a pump.

Figure 8:
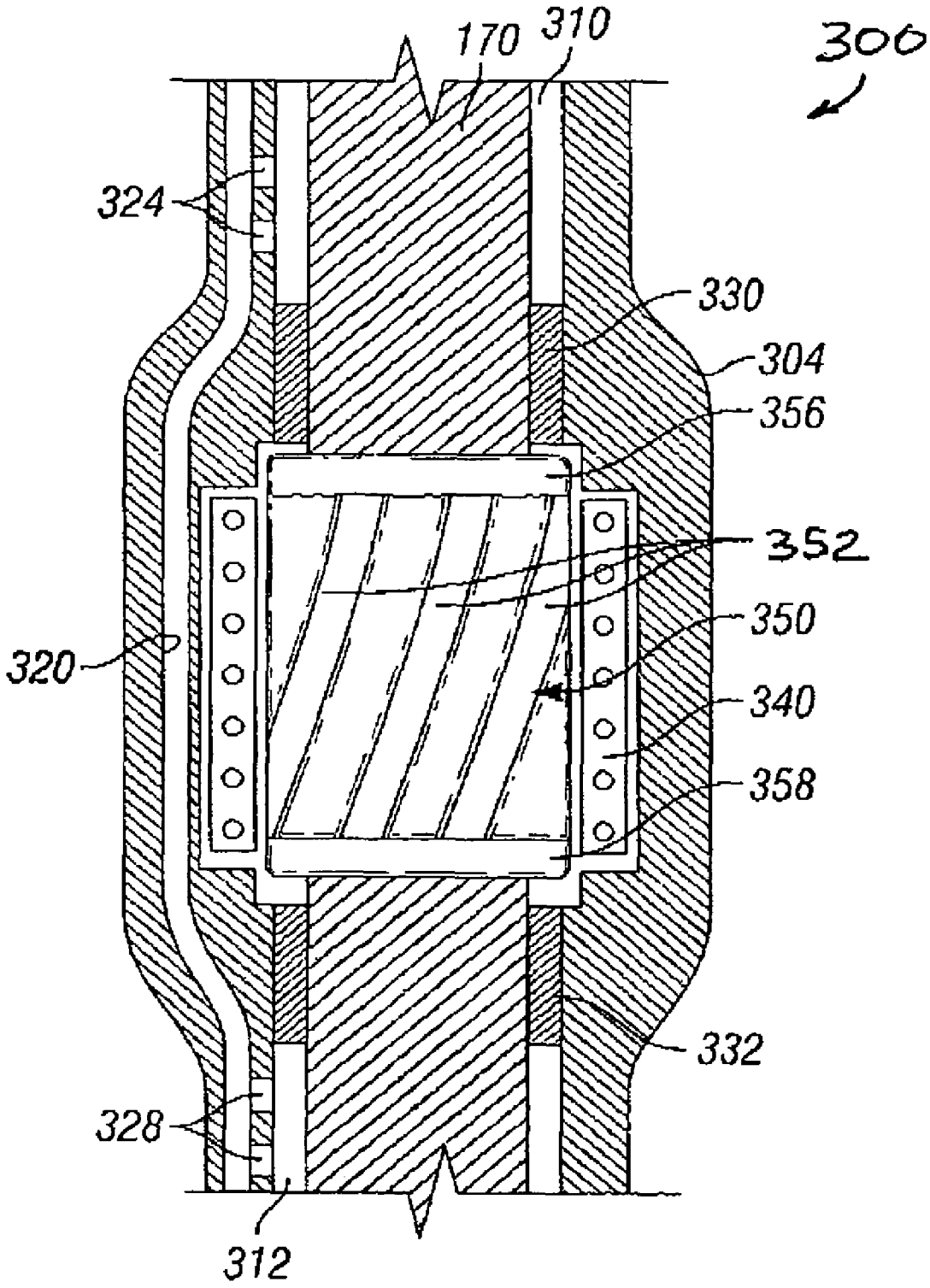
FIG. 8 is a cross-sectional view of an electrical motor according to an embodiment of the invention.

FIG. 8 depicts an exemplary embodiment 300 of a pump actuator (i.e., used for the pump actuator 150 of FIG. 5) in accordance with some embodiments of the invention. The pump actuator 300 is an electrical induction motor for this example. As an example, a wired drill pipe may be used as a telemetry method for controlling the switching of the electrical motor 300 and for purposes of delivering electrical energy to the motor, in accordance with some embodiments of the invention. As shown in FIG. 8, the electrical motor 300 includes a stator 340, which is disposed inside a housing 304 of the motor 300. A cage-type rotor 350 (for this example) having windings 352 and an upper portion 356 and lower portion 358 is disposed inside the stator 340 and rotates in response to electrical energy that is communicated though coils of the stator 340. The rotor 350 is connected to the shaft 170 to cause corresponding rotation of the shaft 170 in response to the stator 340 receiving electrical energy. As also depicted in FIG. 8, the motor 300 may include upper 330 and lower 332 shaft seals for purposes of forming a fluid seal between the shaft 170 and the housing 304 to isolate fluid from the electrical components of the motor 300. The electrical motor 300 may include various components, such as a start-up circuit (as an example), depending on the particular embodiment of the invention.

As also depicted in FIG. 8, in accordance with some embodiments of the invention, the motor 300 includes a fluid bypass that is formed from, for example, radial ports 324 that direct fluid from the central passageway of the string into one or more longitudinal bypass paths 320 (one bypass path 320 being depicted in FIG. 8), which route the fluid flow away from the electrical components of the motor 300. Corresponding radial ports 328 establish communication between the one or more longitudinal passageways 320 and the central passageway of the string 20 below the electrical components of the motor 300.

Figure 9:
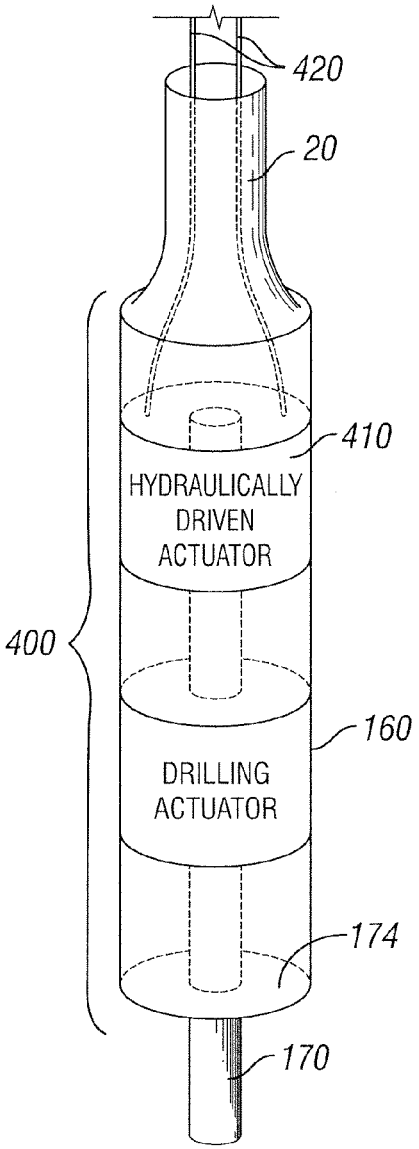
FIGS. 9 and 10 are schematic diagrams of the motor assembly according to different embodiments of the invention.

It is noted that an induction motor is one out of many different types of electrical motors that may be used as the pump actuator in accordance with some embodiments of the invention. Furthermore, actuators other than electrical-based actuators may be used in accordance with other embodiments of the invention. For example, FIG. 9 depicts an alternative motor assembly 400 in accordance with some embodiments of the invention. The motor assembly 400 has the same general design as the motor assembly 30 (see FIG. 3). However, unlike the motor assembly 30, the motor assembly 400 includes a hydraulically-driven actuator 410, which serves as the pump actuator 150 (see FIG. 5). The hydraulically-driven actuator 410 (i.e., the pump actuator) may be driven, for example, via hydraulic lines 420 that extend to the surface of the well. Thus, a pump at the surface of the well may communicate fluid through the hydraulic lines 420 for purposes of rotating the shaft 170 in the appropriate rotational direction during the second mode of the motor assembly 400 in which the motor assembly 400 functions as a pump.

Figure 10:
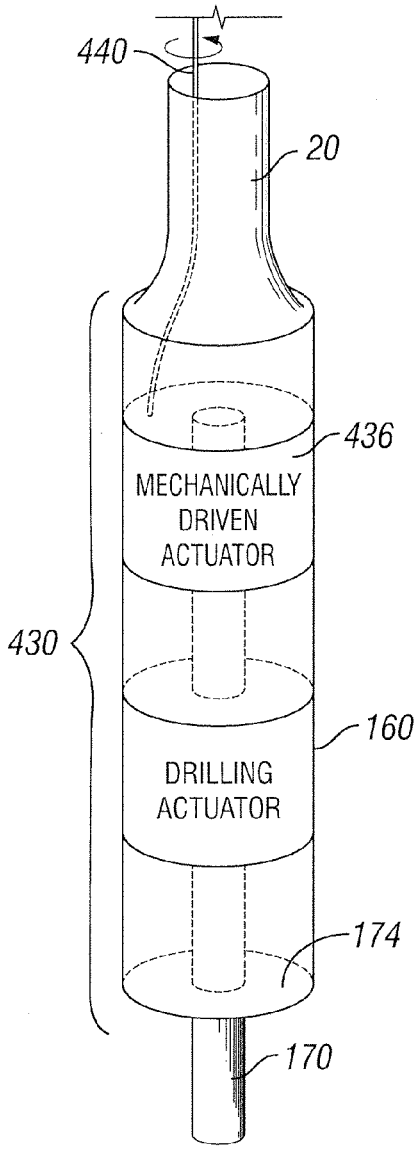
Figure 11:
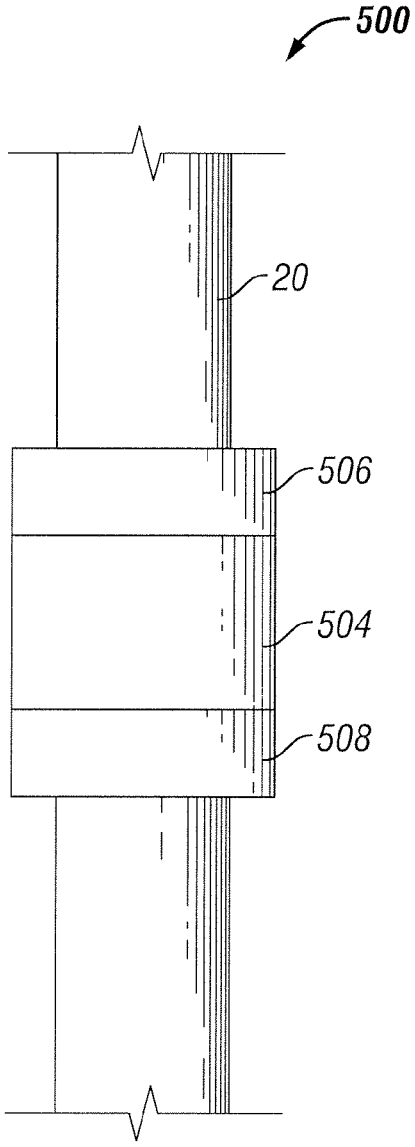
FIGS. 11 and 12 are schematic diagrams of isolation devices of the string according to different embodiments of the invention.

Alternatively, referring to FIG. 10, in accordance with some embodiments of the invention, a motor assembly 430 may be used. The motor assembly 430, similar to the motor assemblies 30 and 400, is activated to rotate the shaft 170 during a second mode of operation. However, the motor assembly 430 includes a mechanically-driven actuator 436 that serves as a pump actuator. The mechanically-driven actuator 436 may be driven by, for example, a rod 440 (a coiled rod, for example) that extends from the mechanically driven actuator 436 to the surface of the well. Thus, the rod 440 may be rotated by a motor at the surface of the well during the second mode of operation for purposes of rotating the shaft 170.

Referring back to FIG. 1, the isolation device 24 may take on a number of different forms, depending on the particular embodiment of the invention. For example, referring to FIG.

11, in accordance with some embodiments of the invention, the isolation device 24 may be a conventional compression-type packer 500. Thus, in accordance with some embodiments of the invention, the packer 500 may include upper 506 and lower 508 thimbles, or collars, which compress an elastomer ring 504 that is disposed in-between the collars 506 and 508 when the packer 500 is set. The compression of the elastomer ring 504 causes the elastomer ring 504 to radially expand to form the annular seal. The packer 500 may be a mechanically-set, weight-set or a hydraulically-set packer (as examples), depending on the particular embodiment of the invention.

Figure 12:
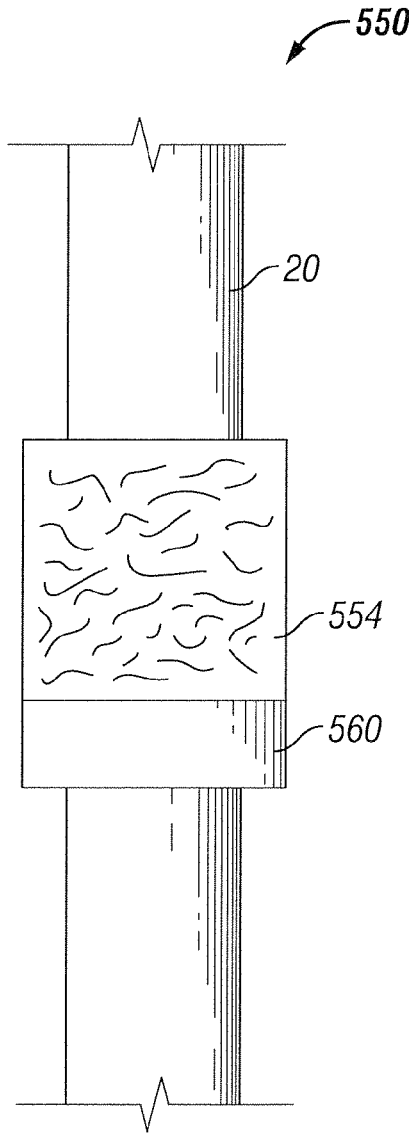

Referring to FIG. 12, in other embodiments of the invention, a swellable material packer 550 may be used for the isolation device 24. In this regard, the packer 550 may include a swellable material 554 that is disposed on the exterior surface of the string 20. The specific construction of the packer 550 may take on numerous forms, depending on the particular embodiment of the invention. For example, in accordance with some embodiments of the invention, the swellable material 550 may swell in the presence of hydrocarbons. The swelling of the material 554 may occur at a relatively slow rate so that the string 20 may be initially used as a drilling string. In this regard, the relatively slow rate of swelling of the swellable material 554 allows the drilling fluid to bypass the swellable material 554 and return to the surface as the borehole is formed. At the conclusion of the drilling operation, additional time may then be allowed for the swellable material 554 to fully radially expand to form the annular seal for the second mode of operation. After the annular seal has been formed, the motor assembly may be converted to operate as a well fluid pump.

In other embodiments of the invention, the packer 550 may include, for example, a downhole reservoir 560, which contains a triggering fluid to activate the swellable material 554. Thus, the swellable material 554 may be triggered by the release of the fluid in the reservoir 560 to swell, and this release may be initiated at the end of the drilling operation. The release of the triggering fluid may occur, for example, in response to a remotely-communicated command that is communicated via the drilling fluid, via an electrical cable, and acoustically, etc. Alternatively, the string 20 may include an isolation device that is formed from a combination of a compression-type packer and a swellable material.

Alternatively, in accordance with some embodiments of the invention, the swellable material 554 may have a controlled rate of swelling and also have the ability to shrink back again should an intervention be needed to retrieve the string 20 from the well. As yet another variation, a slug may be pumped through the string 20 from the surface of the well to initiate the swelling. In this regard, the inner diameter of the swellable material may be expanded by the slug. Once the swelling of the swellable material is initiated, the swelling may then be maintained by the produced flow.

As yet other examples, the isolation device 24 may be an inflatable packer or a combination of an inflatable packer with a swellable material, in accordance with other embodiments of the invention.

In accordance with some embodiments of the invention, the isolation device 24 may be alternatively installed on the casing string 10 instead of being part of the string 20. In this regard, the casing string 10 may include a special casing joint that contains the isolation device. As more specific examples (to name just a few), the joint may be lined with a swellable material or may include an inflatable packer.

The string 20 may include tools other than those described above in accordance with the various possible embodiments of the invention. For example, referring back to FIGS. 1 and 2, in accordance with some embodiments of the invention, the string 20 may include a circulation valve 37 that is located above the motor assembly 30. The circulation valve 37 is closed during the drilling operation and is normally closed during the production of well fluid through the string 20. However, should the motor assembly 30 fail during its second mode of operation, the circulation valve 37 may be opened (via a remotely communicated command stimulus from the surface of the well, for example) to establish a flow into the string above the motor assembly 30. This way, the well fluid may be produced using a gas lift technique.

The string 20 may also include a perforating gun that is fired prior to the beginning of the assembly's second mode of operation. As another example of a potential embodiment of the invention, the string 20 may include sensors for purposes of monitoring drilling and subsequent production from the well. Furthermore, in accordance with some embodiments of the invention, the string 20 may include chemical injection lines. Thus, many variations are possible and are within the scope of the appended claims.

The drilling operation may be an overbalanced or underbalanced drilling operation, depending on the particular embodiment of the invention. In this regard, underbalanced drilling may provide the advantages of time savings and the prevention of formation damage as the drilling nears the production zone. Additionally, the rate of penetration (ROP) may benefit as well from overburden drilling. In other embodiments of the invention, near balance, or managed pressure drilling, may be used in which some degree of pressure control is achieved via choking at the surface of the well.

Referring back to FIG. 1, in accordance with some embodiments of the invention, the central passageway of the string 20 may be sealed during pressure deployment of the string. Once pressure deployed, however, an internal valve (such as a ball valve, for example) that forms the internal seal may be activated to open fluid communication through the central passageway so that drilling and eventually pumping may begin.

Although the techniques and systems that are described herein are particularly advantageous for drilling and then subsequently pumping in a half trip, the techniques and systems may also be advantageous for operations that involve more than a half trip into the well. For example, during drilling, the string 20 may be retrieved for purposes of, for example, changing a drill bit for the case of a long borehole. Although more than one half trip is used, the string 20 is still ultimately used as a production pipe due to the dual use of the motor assembly 30, thereby saving additional trips into the well.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method usable with a well, comprising:

running a motor assembly into the well;

actuating the motor assembly to turn a drill bit; and using the motor assembly to pump well fluid from the well, wherein the act of using and actuating occur after the running and without retrieving the motor assembly from the well and wherein the act of using comprises converting at least part of the motor assembly into a pump.

2. The method of claim 1, wherein actuating the motor assembly comprises:

communicating drilling fluid from the surface of the well to the motor;

contacting an actuator of the motor assembly with the drilling fluid; and rotating a shaft connected to the drill bit in response to the contacting.

3. The method of claim 2, wherein the using comprises:

rotating the actuator; and using the rotation of the actuator to pump well fluid from the well.

4. The method of claim 3, wherein the rotating comprises:

communicating one of mechanical, hydraulic and electrical energy downhole from the surface of the well to rotate the actuator.

5. The method of claim 1, further comprising:

running an isolation device into the well with the motor;

activating the isolation device to isolate an annulus of the well after the actuating.

6. The method of claim 5, wherein the isolation device comprises at least one of the following:

a mechanically-set packer, a weight-set packer, a hydraulically-set packer, an inflatable packer and a swellable material.

7. An assembly usable with a well, comprising:

a tubular member;

a shaft disposed in the tubular member;

a first actuator adapted to in a drilling motor mode of the assembly, turn the shaft in response to fluid communicated through the tubular member from the surface of the well; and a second actuator adapted to in a pump mode of the assembly, turn the shaft to pump well fluid from downhole to the surface of the well, the assembly adapted to operate in drilling motor mode and in pump mode without retrieving the assembly from the well.

8. The assembly of claim 7, wherein the first actuator, in the pump mode, pumps the well fluid to the surface of the well.

9. The assembly of claim 7, wherein the first actuator is adapted to turn the shaft in a first rotation in the drilling motor mode, and the second actuator is adapted to turn the shaft in a second rotation opposite from the first rotation in the pump mode.

10. The assembly of claim 7, wherein the first actuator comprises one of helically disposed ribs and a turbine.

11. The assembly of claim 7, wherein the second actuator comprises one of the following:

an electrical motor, a hydraulically-driven actuator and a mechanically-driven actuator.

12. A system usable with a well, comprising:

a string;

an isolation device adapted to be selectively activated to isolate an annular region outside of the string;

a drill bit;

an assembly adapted to in a first mode of the assembly, turn the drill bit and in a second mode of the assembly, pump well fluid from downhole to the surface of the well, the assembly adapted to perform the first and second modes without retrieving the assembly from the well; and wherein the assembly is adapted to change its source of power based on whether the assembly is in the first mode or in the second mode.

13. The system of claim 12, wherein the assembly is adapted to be driven to turn the drill bit in the first mode in response to fluid that is communicated through the string.

14. The system of claim 12, wherein the assembly is adapted to pump the well fluid through the string in the second mode.

15. The system of claim 12, wherein the assembly comprises an actuator utilized in the first and second modes of the assembly.

16. The system of claim 12, wherein the isolation device comprises at least one of the following:

a mechanically-set packer, a weight-set packer, a hydraulically-set packer, an inflatable packer and a swellable material.

17. The system of claim 12, further comprising:

a valve located above the assembly, the valve adapted to facilitate a gas lift operation to produce well fluid through the string.

18. A system usable with a well, comprising:

a string;

an isolation device adapted to be selectively activated to isolate an annular region outside of the string;

a drill bit;

an assembly adapted to in a first mode of the assembly, turn the drill bit and in a second mode of the assembly, pump well fluid from downhole to the surface of the well, the assembly adapted to perform the first and second modes without retrieving the assembly from the well; and a valve adapted to be closed in the first mode and open in the second mode to receive well fluid.

19. The system of claim 18, wherein the assembly is adapted to be driven to turn the drill bit in the first mode in response to fluid that is communicated through the string.

20. The system of claim 18, wherein the assembly is adapted to pump the well fluid through the string in the second mode.

21. The system of claim 18, wherein the assembly comprises an actuator utilized in the first and second modes of the assembly.

22. The system of claim 18, wherein the assembly is adapted to change its source of power based on whether the assembly is in the first mode or in the second mode.

23. The system of claim 18, wherein the isolation device comprises at least one of the following:

a mechanically-set packer, a weight-set packer, a hydraulically-set packer, an inflatable packer and a swellable material.

24. The system of claim 18, further comprising:

a valve located above the assembly, the valve adapted to facilitate a gas lift operation to produce well fluid through the string.

* * * * *